United States Patent [19]

Greaves et al.

[11] Patent Number: 4,896,094

[45] Date of Patent: Jan. 23, 1990

[54] BANDGAP REFERENCE CIRCUIT WITH IMPROVED OUTPUT REFERENCE VOLTAGE

[75] Inventors: Carlos A. Greaves; Mathew A. Rybicki, both of Austin, Tex.

[73] Assignee: Motorola, Inc., Schaumburg, Ill.

[21] Appl. No.: 375,098

[22] Filed: Jun. 30, 1989

[51] Int. Cl.[4] ..... G05F 3/28

[52] U.S. Cl. ..... 323/314; 323/316; 307/296.7; 330/257

[58] Field of Search ..... 323/311, 313, 314, 315, 323/316; 307/296.1, 296.6, 296.7; 330/257, 288, 293

[56] References Cited

U.S. PATENT DOCUMENTS

| | | | |
|---|---|---|---|
| 3,887,863 | 6/1975 | Brokaw | 323/314 |
| 4,189,671 | 2/1980 | Yuen | 323/314 |
| 4,348,633 | 9/1982 | Davis | 323/314 |
| 4,375,595 | 3/1983 | Ulmer et al. | 307/297 |
| 4,399,399 | 8/1983 | Joseph | 323/316 |
| 4,506,208 | 3/1985 | Nagano | 323/314 |
| 4,795,961 | 1/1989 | Neidorff | 323/314 |

OTHER PUBLICATIONS

Ainsworth et al., "Compensated Voltage Regulator", IBM Technical Disclosure Bulletin, vol. 15, No. 4, Sep. 1972, pp. 1141–1142.

A Programmable CMOS Dual Channel Interface Processor for Telecommunications Applications–Bhupendrak, Ahuja, Paul R. Gray, Wayne M. Baxter, Gregory T. Uehara–IEEE Journal of Solid State Circuits, vol. SC-19, No. 6, Dec. 1984, pp. 892–899.

CMOS Voltage References Using Lateral Bipolar Transistors–Marc G. R. Degrauwe, Oskar N. Leuthold, Eric A. Vittoz, Henri J. Oguey, Arthur Descombes-:-IEEE Journal of Solid State Circuits, vol. SC-20, No. 6, Dec. 1985–pp. 1151–1157.

*Primary Examiner*—Peter S. Wong
*Attorney, Agent, or Firm*—Robert L. King

[57] ABSTRACT

A bandgap reference circuit providing a continuous output reference voltage. The bandgap reference circuit comprises an operational amplifier, an output circuit, and a compensation circuit. The operational amplifier receives a first input signal and a second input signal and provides an output signal in response to a difference in voltage between the first input signal and the second input signal. The output circuit receives the output of the operational amplifier and provides an output reference voltage. The output circuit provides the first input signal and the second input signal to the operational amplifier in such a way as to maintain the output reference voltage at a substantially constant value. The compensation circuit provides a current to the output circuit to compensate for currents conducted from the bases of transistors in an input stage of the operational amplifier, thereby making the output reference voltage more stable.

8 Claims, 2 Drawing Sheets

-PRIOR ART-

40
$V_{BG}$
$V_{DD}$
PBIAS
PBIAS
$V_{SS}$
$R_1$
$R_2$
$R_1$
100
80
60
50
42
41
43
44
45
46
47
48
52
54
56
61
62
63
64
65
66
68
69
72
74
76
82
84
86
91
92
93
94
96
98
99
102
104
106

BANDGAP REFERENCE CIRCUIT WITH IMPROVED OUTPUT REFERENCE VOLTAGE

FIELD OF THE INVENTION

This invention relates generally to voltage reference circuits, and more particularly, to bandgap reference circuits.

BACKGROUND OF THE INVENTION

A bandgap reference circuit provides a stable output reference voltage, and is typically used in large integrated circuits for applications such as in telecommunications. It is desirable for the output reference voltage to remain stable with respect to temperature, manufacturing process variations, and in the case of a bandgap reference circuit to provide a continuous output reference voltage. The output reference voltage provided by known bandgap circuits, however, typically varies somewhat with respect to one or more of these factors.

A basic bandgap reference circuit 10 known in the art is shown in FIG. 1, and further described by Ahuja, B. et al., "A Programmable CMOS Dual Channel Interface Processor for Telecommunications Applications", *IEEE Journal of Solid State Circuits,* vol. SC-19, no. 6, Dec. 1984. Bandgap reference circuit 10 generally comprises an output circuit 20 and an operational amplifier 30. Output circuit 20 comprises a resistor 21, a resistor 22, a resistor 23, a bipolar transistor 25, and a bipolar transistor 26. Operational amplifier 30 comprises an ideal operational amplifier 32, and an offset voltage source 34. Ideal operational amplifier 32 has a positive input terminal, a negative input terminal, and an output terminal providing a bandgap reference voltage signal $V_{BG}$. Offset voltage source 34 has a positive terminal, and a negative terminal connected to the negative input terminal of ideal operational amplifier 32. Resistor 21 has a first terminal connected to the output of ideal operational amplifier 32, and a second terminal connected to the positive input terminal of ideal operational amplifier 32. Resistor 22 has a first terminal connected to the output of ideal operational amplifier 32, and a second terminal connected to the positive terminal of offset voltage source 34. Resistor 23 has a first terminal connected to the positive terminal of offset voltage source 34, and a second terminal. Transistor 25 has an emitter connected to the second terminal of resistor 21, a base connected to a negative power supply voltage terminal $V_{SS}$, typically zero volts, and a collector connected $V_{SS}$. Transistor 26 has an emitter connected to the second terminal of resistor 23, a base connected to $V_{SS}$, and a collector connected to $V_{SS}$.

Bandgap reference circuit 10 provides output reference voltage $V_{BG}$, whose value depends on the sizes of the components in a feedback loop of output circuit 20 between the positive input terminal and the negative input terminal of ideal operational amplifier 32. The value of $V_{BG}$ can be determined because an ideal operational amplifier changes its output until a voltage on the positive input terminal equals a voltage on the negative input terminal, in accordance with the following equation:

$$V_{BG}=V_{BE1}+(R1/R2)\Delta V_{BE}+(1+R1/R2)V_{OS}$$

where $V_{BE1}$ represents the base-to-emitter voltage drop of transistor 25, $V_{BE2}$ represents the base-to-emitter voltage drop on transistor 26, $\Delta V_{BE}$ represents the difference in base-to-emitter voltages between transistor 25, $V_{BE1}$, and transistor 26, $V_{BE2}$, $V_{OS}$ represents the voltage provided by offset voltage source 34, R1 represents the resistance of either resistor 21 or resistor 22, and R2 represents the resistance of resistor 23. As the performance of the operational amplifier improves and approaches that of an ideal operational amplifier, $V_{OS}$ approaches zero volts.

The base-to-emitter voltage of a bipolar transistor, labelled in general $V_{BE}$, decreases as temperature increases. On the other hand, $\Delta V_{BE}$ rises with respect to temperature. Therefore R1 and R2 can be chosen to compensate for this variability with respect to temperature, such that as $V_{BE1}$ rises, $(R1/R2)\Delta V_{BE}$ falls in proportion, keeping $V_{BG}$ unaffected. However $V_{OS}$ introduces a component to $V_{BG}$ for which the values of R1 and R2 cannot compensate. If CMOS technology is used, $V_{OS}$ is typically from 10 to 20 millivolts, and varies with temperature, so that bandgap reference circuit 10 provides a relatively unstable output reference voltage. Several methods have been used to improve the output reference voltage of the basic bandgap reference circuit. One method is disclosed by Ulmer and Whatley in U.S. Pat. No. 4,375,595. This method relies on a technique in which the output reference voltage of the bandgap reference circuit is not always available, however, and so cannot be used for applications requiring a continuous output reference voltage.

In time-continuous output reference voltage applications, a known method to lower variability of the output reference voltage with variations in temperature, due to the effect of the offset voltage, is to utilize an area ratioed stack of bipolar transistors in the output circuit to provide the feedback loop, as disclosed in the previously mentioned Ahuja reference. The area ratioed stack approach utilizes a larger feedback loop than output circuit 20 of bandgap reference circuit 10. Instead of a single transistor, for example transistor 25, connected to an input of the operational amplifier, two or more transistors are used in a chained fashion, wherein the emitter of a transistor is connected to the base of the next transistor of the chain. The contribution of the error term, defined as $(1+R1/R2)V_{OS}$, is a smaller fraction of $V_{BG}$, because the absolute value of $V_{BG}$ is increased.

In CMOS processing, bipolar transistors which have stable threshold characteristics well suited for use in bandgap reference circuits can be fabricated in either of two modes. See, for example, Degrauwe, M., et al., "CMOS Voltage References Using Lateral Bipolar Transistors," *IEEE Journal of Solid Stae Circuits,* vol SC-20, no. 6, Dec. 1985. In a vertical implementation, a bipolar transistor is formed by a diffusion, a well, and a substrate forming an emitter, a base, and a collector. The vertical bipolar transistor is limited in that the collector, being formed in the substrate, is typically tied to a power supply terminal. In a lateral implementation, a bipolar transistor is formed by a first diffusion, a well, a second diffusion, a substrate, and a gate, as disclosed by Degrauwe et al. In the lateral implementation, a free collector is available, but a proportion of an emitter current flowing out of the free collector varies widely, from about 30% to 70%. Use of lateral bipolar transistors as input transistors of an operational amplifier with low offset voltage is taught by Rybicki et al. in U.S. patent application, Ser. No. 358,980 filed 5-30-89, entitled "An Operational Amplifier with Reduced Offset Voltage Using Lateral Bipolar Transistors." However the existence and variability in currents of the lateral bipolar transistors in the input stage of the operational amplifier can create errors in applications such as bandgap reference circuit 10.

BRIEF DESCRIPTION OF THE INVENTION

Accordingly, it is an object of the present invention to provide an improved bandgap reference circuit.

It is another object of the present invention to provide a bandgap reference circuit with an improved output reference voltage.

It is yet another object of the present invention to provide an improved bandgap reference circuit with a continuous output reference voltage.

In carrying out these and other objects of the invention, there is provided, in one form, a bandgap reference circuit providing a continuous output reference voltage. The bandgap reference circuit comprises an operational amplifier, an output portion, and a compensation portion. The operational amplifier receives a first input signal and a second input signal and provides an output signal in response to a difference in voltage between the first input signal and the second input signal. The output portion receives the output signal of the operational amplifier and provides an output reference voltage. The output portion provides the first input signal and the second input signal to the operational amplifier having values which maintain the reference voltage at a substantially constant value. The compensation portion provides a current to the output portion to compensate for a current conducted by the operational amplifier, thereby making the output reference voltage more stable.

These and other objects, features and advantages will be more clearly understood from the following detailed description taken in conjunction with the accompanying drawings.

DETAILED DESCRIPTION OF THE INVENTION

Figure 2:
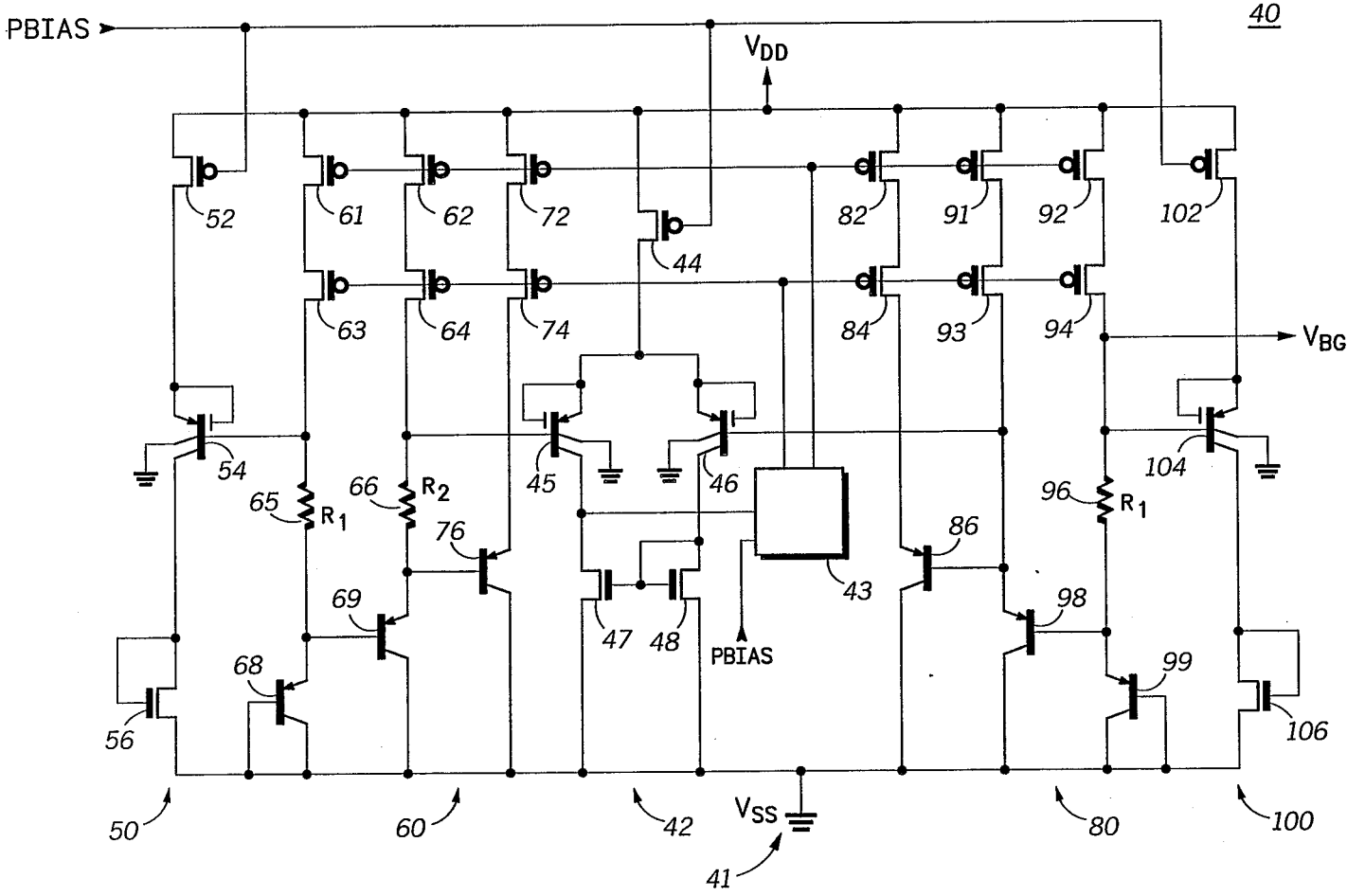
FIG. 2 shows in partial schematic form the bandgap reference circuit of the present invention.

FIG. 2 shows a bandgap reference circuit 40 in accordance with the present invention. Bandgap reference circuit 40 generally comprises an operational amplifier 41, a first compensation portion 50, a first output portion 60, a second output portion 80, and a second compensation portion 100. Operational amplifier 41 comprises an input stage 42, and an output stage 43, shown generally in block diagram form. First compensation portion 50 comprises a P-channel transistor 52, a PNP lateral bipolar transistor 54, and an N-channel transistor 56. First output portion 60 comprises a P-channel transistor 61, a P-channel transistor 62, a P-channel transistor 63, a P-channel transistor 64, a resistor 65, a resistor 66, a PNP vertical bipolar transistor 68, a PNP vertical bipolar transistor 69, a P-channel transistor 72, a P-channel transistor 74, and a PNP vertical bipolar transistor 76. Second output portion 80 comprises a P-channel transistor 82, a P-channel transistor 84, a PNP vertical bipolar transistor 86, a P-channel transistor 91, a P-channel transistor 92, a P-channel transistor 93, a P-channel transistor 94, a resistor 96, a PNP vertical bipolar transistor 98, and a PNP vertical bipolar transistor 99. Second compensation portion 100 comprises a P-channel transistor 102, a PNP lateral bipolar transistor 104, and an N-channel transistor 106. In one form, transistors 52, 56, 61–64, 72, 74, 82, 84, 91–94, 102, and 106 are MOS transistors. Although specific N-channel and P-channel MOS transistors are shown, it should be well understood that other types of transistors and conductivities may be used.

In operational amplifier 41, input stage 42 comprises a P-channel transistor 44, a PNP lateral bipolar transistor 45, a PNP lateral bipolar transistor 46, an N-channel transistor 47, and an N-channel transistor 48. Transistor 44 has a source connected to a first power supply voltage terminal $V_{DD}$, a gate for receiving signal PBIAS, and a drain. $V_{DD}$ is a positive power supply voltage terminal. Lateral bipolar transistor 45 has an emitter connected to the drain of transistor 44, a base providing a negative input terminal of operational amplifier 41, a free collector providing an input stage output signal, a substrate collector connected to a second power supply voltage terminal $V_{SS}$, and a gate connected to the emitter of lateral bipolar transistor 45. $V_{SS}$ is a negative power supply voltage terminal having a potential lower than $V_{DD}$. Lateral bipolar transistor 46 has an emitter connected to the drain of transistor 44, a base for providing a positive input terminal, a free collector, a substrate collector connected to $V_{SS}$, and a gate connected to the emitter of lateral bipolar transistor 46. Transistor 47 has a drain connected to the free collector of lateral bipolar transistor 45, a gate connected to the free collector of lateral bipolar transistor 46, and a source connected to VSS. Transistor 48 has a drain connected to the free collector of lateral bipolar transistor 46, a gate connected to the drain of transistor 48, and a source connected to $V_{SS}$. Second stage 43 receives the input stage output signal, receives PBIAS, and provides a first output signal and a second output signal.

In first compensation portion 50, transistor 52 has a source connected to $V_{DD}$, a gate receiving a bias voltage labelled PBIAS, and a drain. Lateral bipolar transistor 54 has an emitter connected to the drain of transistor 52, a base, a free collector, a substrate collector connected to $V_{SS}$, and a gate connected to the emitter of lateral bipolar transistor 54. Transistor 56 has a drain connected to the free collector of lateral bipolar transistor 54, a gate connected to the drain of transistor 56, and a source connected to $V_{SS}$.

In first output portion 60, transistor 61 has a source connected to $V_{DD}$, a gate for receiving the first output signal, and a drain. Transistor 62 has a source connected to $V_{DD}$, a gate for receiving the first output signal, and a drain. Transistor 63 has a source connected to the drain of transistor 61, a gate for receiving the second output signal, and a drain connected to the base of lateral bipolar transistor 54. Transistor 64 has a source connected to the drain of transistor 62, a gate for receiving the second output signal, and a drain connected to the negative input terminal of operational amplifier 41. Resistor 65 has a first terminal connected to the drain of transistor 63, and a second terminal. Resistor 66 has a first terminal connected to the drain of transistor 64, and a second terminal. Transistor 68 has an emitter connected to the second terminal of resistor 65, a base connected to $V_{SS}$, and a collector connected to $V_{SS}$. Transistor 69 has an emitter connected to the second terminal of resistor 66, a base connected to the emitter of transistor 68, and a collector connected to $V_{SS}$. Transistor 72 has a source connected to $V_{DD}$, a gate for receiving the first output signal, and a drain. Transistor 74 has a source connected to the drain of transistor 72, a gate for receiving the second output signal, and a drain. Transistor 76 has an emitter connected to the drain of transistor 74, a base connected to the emitter of transistor 69, and a collector connected to $V_{SS}$.

In second output portion 80, transistor 82 has a source connected to $V_{DD}$, a gate for receiving the first output signal, and a drain. Transistor 84 has a source connected to the drain of transistor 82, a gate for receiving the second output signal, and a drain. Transistor 86 has an emitter connected to the drain of transistor 74, a base, and a collector connected to $V_{SS}$. Transistor 91 has a source connected to $V_{DD}$, a gate for receiving the first output signal, and a drain. Transistor 92 has a source connected to $V_{DD}$, a gate for receiving the first output signal, and a drain. Transistor 93 has a source connected to the drain of transistor 91, a gate for receiving the second output signal, and a drain connected to the positive input terminal of operational amplifier 41. Transistor 94 has a source connected to the drain of transistor 92, a gate for receiving the second output signal, and a drain for providing output reference voltage $V_{BG}$. Resistor 96 has a first terminal connected to the drain of transistor 94, and a second terminal. Transistor 98 has an emitter connected to the drain of transistor 93 and to the base of transistor 86, a base connected to the second terminal of resistor 96, and a collector connected to $V_{SS}$. Transistor 99 has an emitter connected to the second terminal of resistor 96, a base connected to $V_{SS}$, and a collector connected to $V_{SS}$.

In second compensation portion 100, transistor 102 has a source connected to $V_{DD}$, a gate for receiving PBIAS, and a drain. Lateral bipolar transistor 104 has an emitter connected to the drain of transistor 102, a base connected to the drain of transistor 94, a free collector, a substrate collector connected to $V_{SS}$, and a gate connected to the emtter of lateral bipolar transistor 104. Transistor 106 has a drain connected to the free collector of lateral bipolar transistor 104, a gate connected to the drain of transistor 106, and a source connected to $V_{SS}$.

Bandgap reference circuit 40 of FIG. 2 combines an area ratioed stacked bipolar structure with a low-offset operational amplifier formed using lateral bipolar transistors to provide a bandgap reference circuit. Base current cancellation circuits compensate for the base current and thus the variation in base current conducted at the positive and negative inputs of operational amplifier 41 due to processing variations. Bandgap reference circuit 40 thereby provides improved performance over other bandgap reference circuits known in the art.

Figure 1:
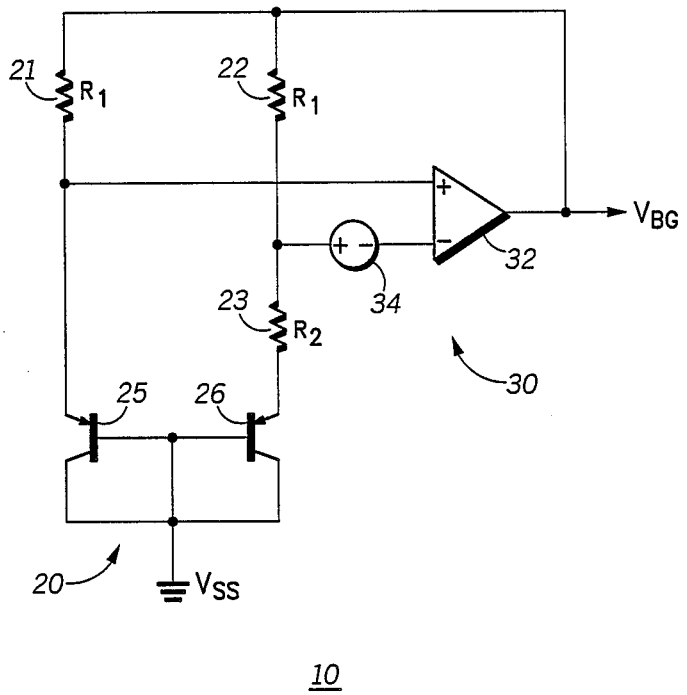
FIG. 1 shows a circuit diagram of a basic bandgap reference circuit known in the art.

In basic operation, bandgap reference circuit 40 functions similarly to bandgap reference circuit 10 of FIG. 1. In each case, an operational amplifier attempts to keep voltages at its input terminals equal, through feedback, by changing a voltage or two voltages at its output. In bandgap reference circuit 40, a difference in voltage between the positive input terminal and the negative input terminal causes a change in voltage on the first output signal and the second output signal that are the outputs of operational amplifier 41. The first output signal and the second output signal change until the voltage on the input terminals is substantially equal. The first output signal and the second output signal change the voltage on the positive input and on the negative input through feedback obtained by modulating the amount of current flowing through output portions 60 and 80. Transistors 61 and 63 collectively function as a current source, whose current is controlled by the first output signal and the second output signal, respectively. Similarly, transistors 62 and 64, 72 and 74, 82 and 84, 91 and 93, and 92 and 94, form pairs of transistors functioning as current sources to force currents through corresponding transistors in response to the first output signal and the second output signal, respectively. It should be apparent that an operational amplifier with a single voltage output signal, along with a single transistor receiving the single voltage output signal, could be used to implement a current source in accordance with the present invention. Transistors 52 and 102 each receive signal PBIAS, and each functions as a current source. In contrast to the first output signal and the second output signal, which regulate current sources in response to a voltage difference on the positive input terminal and the negative input terminal, PBIAS is a constant voltage. PBIAS is also used to bias current source transistors in operational amplifier 41.

Operational amplifier 41 provides two output signals which bias transistors forming current sources in first output portion 60 and second output portion 80. In input stage 42, two lateral bipolar transistors provide the positive input terminal and the negative input terminal. Output stage 43 provides the two output signals to bias the transistors in first output portion 60 and second output portion 80. Operational amplifier 41 provides a low offset voltage through use of lateral bipolar transistors 45 and 46, and a corresponding lateral bipolar transistor in output stage 43, as disclosed in the Rybicki et al. application cited above, and details of input stage 42 are included here for purposes of discussion.

As in operational amplifier 10 of FIG. 1, operational amplifier 41 attempts to make a voltage difference between the negative input terminal, formed by the base of lateral bipolar transistor 45, and the positive input terminal, formed by the base of lateral bipolar transistor 46, equal to zero. Using this requirement, and solving for $V_{BG}$, $$V_{BG}=V_{BE1}+2(R1/R2)\Delta V_{BE}+(R1/R2)V_{OS}$$

where $V_{BE1}$ is equal to the base-to-emitter voltage of transistor 99, $\Delta V_{BE}$ is equal to a difference of base-to-emitter voltages of either transistor 98 or 99 and either transistor 68 or 69, respectively, and $V_{OS}$ is the offset voltage of operational amplifier 41. In a preferred form, the sizes of transistors 68, 69, and 76 are all equal. The sizes of transistors 86, 98, and 99 are all equal and are different from the sizes of transistors 68, 69, and 76 so as to provide a non-zero $\Delta V_{BE}$, which allows R1 and R2 to compensate for temperature variations. Furthermore, the sizes of transistors 63, 64, and 74 are equal; the sizes of transistors 84, 93, and 94 are equal; the sizes of transistors 61, 62, and 72 are equal; and the sizes of transistors 82, 91, and 92 are equal. Lateral bipolar transistors 54 and 104 are ratioed to match lateral bipolar transistors 45 and 46; the sizes of transistors 52 and 102 are ratioed to one half the size of transistor 44; and the sizes of transistors 56 and 106 are ratioed to match transistors 47 and 48. In a preferred form, the sizes of transistors 68, 69, and 76 are each approximately thirty times the sizes of transistors 99, 98, and 86, respectively. Also, the sizes of transistors 61, 62, and 72 are equal to the sizes of transistors 92, 91, and 82, and the sizes of transistors 63, 64, and 74 are equal to the sizes of transistors 94, 93, and 84. However, other ratios besides the three mentioned are possible to maintain the temperature independence of $V_{BG}$.

To be able to choose a value for R1 and R2 that compensates well for changes in temperature, $V_{OS}$ should be made as close to zero as possible. Operational amplifier 41 provides a lower offset voltage than circuits known in the art. Further, the $V_{BE}$ of transistors 68 and 69 should be equal, and the $V_{BE}$ of transistors 98 and 99 should be equal, so that the change in $\Delta V_{BE}$ and $V_{BE}$ with respect to temperature is constant and known.

First compensation portion 50 and second compensation portion 100 compensate for the use of low-offset operational amplifier 41 such that $V_{BE}$ is the same for transistors 68 and 69, and for transistors 98 and 99, which also assures the same $\Delta V_{BE}$. To illustrate, consider a current flowing into the emitter of transistor 69. Let this current be equal to $I_{E69}$. Furthermore, let a current conducted at the negative input terminal of operational amplifier 41, at the base of lateral bipolar transistor 45, be equal to $I_{B0}$, and a current conducted at the base of transistor 76 be equal to $I_B$. If a current provided by the current source formed by transistors 62 and 64 is equal to I, then $$I_{E69}=I+I_{B0}+I_B.$$

Further, if $I_{C69}$ equals the collector current of transistor 69, $$I_{C69}=I+I_{B0}+I_B-I_B=I+I_{B0}$$

since transistor 76 provides a current equal to $I_B$ that matches the base current of transistor 69. In order for transistors 68 and 69 to provide a stable reference, $V_{BE68}$ must equal $V_{BE69}$, and be relatively constant with respect to processing variations. $V_{BE}$ in turn is a function of the collector current. Therefore, for $V_{BE68}$ to equal $V_{BE69}$, the collector current of transistor 68, $I_{C68}$, must also equal $(I+I_{B0})$. Since operational amplifier 41 works to keep the voltages on its inputs equal, operational amplifier 41 regulates current I such that $I_{C69}$ remains constant as $I_{B0}$ changes with variations in processing and temperature. By keeping $I_{C69}$ constant, $V_{BE}$ remains constant.

Since lateral bipolar transistor 54 is matched to lateral bipolar transistor 45, lateral bipolar transistor 54 introduces the same base current $I_{B0}$ at the emitter of transistor 68 as lateral bipolar transistor 45 introduces at the emitter of transistor 69. Furthermore, by matching lateral bipolar transistor 54 to lateral bipolar transistor 45, the base current $I_{B0}$ will be the same at all times for both transistors, regardless of manufacturing process variations which vary the proportion of current flowing through the free collector and the substrate collector of lateral bipolar transistors by wide margins. Bandgap reference circuit 40 further differs from the stacked bipolar bandgap reference circuit disclosed by Ahuja et al. referred to above by the method used to obtain the reference voltage. Bandgap reference circit 40 obtains $V_{BG}$ from one $V_{BE}$ and two $\Delta V_{BE}$. The reference voltage VBG therefore can be compensated for by using a lower ratio of R1 to R2. Hence the contribution of the offset term $(R1/R2)V_{OS}$ is further reduced. In other embodiments, a greater number of bipolar transistors in the stack in the output portions can be used to reduce further the contribution of the offset term $(R1/R2)V_{OS}$.

In a similar fashion, second compensation portion 100 adds an appropriate base current $I_{B0}$ to transistor 99. Transistor 86 also adds the same base current $I_B$ to the emitter of transistor 98 that transistor 98 adds to the emitter of transistor 99. Collector currents, and therefore $V_{BE}$, of transistor 98 and transistor 99 remain equal. In this way, first compensation portion 50 and second compensation portion 100 keep corresponding $V_{BE}$ values equal and allow the use of the low offset operational amplifier 41, reducing an error component of $V_{BG}$ that cannot be compensated by choice of resistor values, and furthermore allowing R1 and R2 to be chosen to make $V_{BG}$ more independent of temperature.

While the invention has been described in the context of a preferred embodiment, it will be apparent to those skilled in the art that the present invention may be modified in numerous ways and may assume many embodiments other than that specifically set out and described above. Accordingly, it is intended by the appended claims to cover all modifications of the invention which fall within the true spirit and scope of the invention.

We claim:

1. A bandgap reference circuit, for continuously providing an output reference voltage, comprising:

an operational amplifier, having a first input terminal, a second input terminal, and an output terminal;

a first circuit portion, coupled to a first power supply voltage terminal, to a second power supply voltage terminal, to the output terminal of the operational amplifier, and to the positive terminal of the operational amplifier, for providing a first feedback signal to the first input terminal of said operational amplifier, and for providing the output reference voltage;

a second circuit portion, coupled to the first power supply voltage terminal, to the second power supply voltage terminal, to the output terminal of the operational amplifier, and to the second input terminal of the operational amplifier, for providing a second feedback signal to the second input terminal of said operational amplifier;

first compensation means, coupled to the first power supply voltage terminal, to the second power supply voltage terminal, and to the first circuit portion, for providing a current in the first circuit portion proportional to a current conducted at the first input terminal of said operational amplifier; and second compensation means, coupled to the first power supply voltage terminal, to the second power supply voltage terminal, and to the second circuit portion, for providing a second current in the second circuit portion proportional to a current conducted at the second input terminal of said operational amplifier, wherein the first feedback signal and the second feedback signal each has a magnitude proportional to a voltage on the output terminal of the operational amplifier.

2. The bandgap reference circuit of claim 1, wherein said operational amplifier comprises:

a first bipolar transistor for receiving the positive input signal; and a second bipolar transistor for receiving the negative input signal, wherein said first compensation means comprises a third bipolar transistor, and wherein said second compensation means comprises a fourth bipolar transistor.

3. The bandgap reference circuit of claim 1, wherein said operational amplifier comprises:

a first lateral bipolar transistor for receiving the positive input signal; and a second lateral bipolar transistor for receiving the negative input signal, wherein said first compensation means comprises a third lateral bipolar transistor, and wherein said second compensation means comprises a fourth lateral bipolar transistor.

4. The bandgap reference circuit of claim 3, wherein the first compensation means comprises:

a first current source, having a first terminal coupled to the first power supply voltage terminal, and a second terminal; and a fifth transistor, having a first current electrode, a control electrode coupled to the first current electrode of the fifth transistor, and a second current electrode coupled to the second power supply voltage terminal, wherein the third lateral bipolar transistor has an emitter coupled to the second terminal of the first current source, a base coupled to the first circuit portion for sourcing a first base current, and a free collector coupled to the first current electrode of the fifth transistor, and wherein the second compensation means comprises:

a second current source, having a first terminal coupled to the first power supply voltage terminal, and a second terminal;

a sixth transistor, having a first current electrode, a control electrode coupled to the first current electrode of the sixth transistor, and a second current electrode coupled to the second power supply voltage terminal, wherein the fourth transistor has an emitter coupled to the second terminal of the second current source, a base coupled to the second circuit portion for sourcing a second base current, and a free collector coupled to the first current electrode of the sixth transistor.

5. The bandgap reference circuit of claim 4, wherein the first, second, third and fourth transistors all have substantially equal transistor size and base current.

6. A bandgap reference circuit for continuously providing an output reference voltage, comprising:

operational amplifier means, for providing an output signal which varies in response to a difference at a first input terminal and a second input terminal thereof;

output means coupled to the operational amplifier means, for providing the output reference voltage, and for receiving the output signal of the operational amplifier means and providing a first feedback signal at the first input terminal and a second feedback signal at the second input terminal so as to maintain the output reference voltage at a substantially constant voltage; and compensation means coupled to the output means, for providing to the output means a first compensation current equal to a first current conducted at said first input terminal, and a second compensation current equal to a second current conducted at said second input terminal, said first compensation current and said second compensation current further stabilizing the output reference voltage by controlling current conducted by the output means.

7. In a bandgap reference circuit comprising:

operational amplifier means, for providing an output signal which varies in response to a difference at a first input terminal and a second input terminal thereof; and output means coupled to the operational amplifier means, for providing the output reference voltage, and for receiving the output signal of the operational amplifier means and providing a a first feedback signal at the first input terminal and a second feedback signal at the second input terminal so as to maintain the output reference voltage at a substantially constant voltage, a method for providing an improved output reference voltage, comprising the steps of:

providing a low offset operational amplifier as the operational amplifier means; and compensating said output means by providing at least one current to the output means to compensate for error current in the operational amplifier means which can vary the output reference voltage.

8. The method of claim 7, wherein said error current is conducted from at least one base of a lateral bipolar transistor, and said compensation current is conducted from at least one base of another lateral bipolar transistor.

* * * * *